US005318233A

United States Patent [19]

Zollinger

[11] Patent Number: 5,318,233

[45] Date of Patent: Jun. 7, 1994

[54] BALL TENSION DEVICE

[76] Inventor: Otto Zollinger, 120 Pine Acres Dr., Spartanburg, S.C. 29304

[21] Appl. No.: 12,438

[22] Filed: Feb. 2, 1993

[51] Int. Cl.[5] ..... B65H 51/20; B65H 59/24

[52] U.S. Cl. ..... 242/47.01; 242/152.1

[58] Field of Search ..... 242/47.01, 47.12, 152.1

[56] References Cited

U.S. PATENT DOCUMENTS

| | | | |
|---|---|---|---|
| 2,677,511 | 5/1954 | Bley | 242/152.1 X |
| 3,874,613 | 4/1975 | Zollinger | 242/152.1 |
| 3,897,916 | 8/1975 | Rosen | 242/152.1 X |
| 3,931,939 | 1/1976 | Rosen | 242/47.01 |
| 4,017,038 | 4/1977 | Paepke | 242/152.1 |
| 4,137,731 | 2/1979 | Jacobsson | 242/47.01 X |
| 4,138,866 | 2/1979 | Fecker et al. | 242/47.01 X |
| 4,352,471 | 10/1982 | Zust | 242/152.1 X |
| 4,558,834 | 12/1985 | Plucknett | 242/152.1 |
| 4,568,038 | 2/1986 | Frentzel-Beyme | 242/152.1 |

FOREIGN PATENT DOCUMENTS

| | | | |
|---|---|---|---|
| 2200072 | 8/1973 | Fed. Rep. of Germany | 242/152.1 |
| 19365 | of 1909 | United Kingdom | 242/152.1 |

*Primary Examiner*—Stanley N. Gilreath
*Attorney, Agent, or Firm*—Shefte, Pinckney & Sawyer

[57] ABSTRACT

A ball tension device for producing generally uniform tension in a traveling textile yarn, particularly in combination with a yarn storage and supply apparatus of the rotating drum type. A base portion has a yarn passageway with an upwardly facing annular ball seat. A ball freely rotatably rests on the seat to apply a force to a yarn passing over the seat and through the passageway. A ball retaining portion extends over the ball at an upward spacing sufficient to allow upward movement of the ball but insufficient to allow removal of the ball. These base and ball retaining portions project transversely from a mounting portion to provide a substantial open space to permit entry of a downwardly inclined traveling yarn. The ball retaining portion is imperforate to provide a cover for the ball and seat to shield the ball and seat from accumulation of lint. Similarly, the substantial open space around the ball and seat tends to minimize lint accumulation. The ball retaining portion is formed with an undersurface facing the ball and has an upwardly extending recess to accommodate upward movement of the ball while the ball retaining member otherwise retains the ball against displacement from the device. This recess may be elongated to accommodate transverse movement of the ball during threading. For the same purpose, the mounting portion may be formed with a recess in the surface facing the ball to permit movement of the ball transversely to accommodate threading.

12 Claims, 3 Drawing Sheets

BALL TENSION DEVICE

BACKGROUND OF THE INVENTION

The present invention relates to ball tension devices for controlling tension in yarn being fed to textile machines to obtain substantially uniform tension for enhanced efficiency of operation and quality of the textile product being processed or manufactured.

Ball tension devices have proven to be highly successful in controlling the efficient manufacture of high quality textile products by maintaining substantially uniform tension in yarn being fed in textile manufacturing and processing equipment of various types, such as textile winders, warpers, spinning machines, knitting machines, and the like. The original ball tension device which has become universally used and has proven to be highly successful in providing uniform tension in a traveling yarn with resulting high quality products at high operating efficiency is the type in which a ball is retained in a cylindrical housing on a seat at the bottom of the housing and at the top of a yarn passageway through which a yarn travels upwardly between the ball and seat and through the housing, with the ball applying a tensioning force to the yarn and being freely movable from the seat under the influence of variations in the tension of the yarn entering the device so as to vary the applied tension and thereby produce a substantially uniform tension in the yarn exiting the device. Such a ball tension device is used with each yarn being fed to a particular machine so that all of the yarns are fed to the machine with substantially equal and uniform tension.

Variations in this basic yarn tension device have been developed over the years for particular uses. For example, various yarn guide configurations have been developed, the size and number of balls have been varied, the direction of yarn travel has been varied to exit to the side rather than primarily upwardly or to travel transversely across the seat and under the ball rather than upwardly between the ball and seat, and various combinations with other equipment components have been developed, such as with balloon breakers and yarn break sensors.

SUMMARY OF THE INVENTION

The present invention provides another important variation of the basic ball tension device that has special advantage in particular applications. For example, where the yarn being fed to the device is under light, but varying, tension and it is desirable to feed the yarn to the processing or manufacturing equipment at a more uniform tension.

The ball tension device of the present invention has special advantage when used with a yarn storage and supply device that controls the feed of yarn to knitting machines by winding the yarn onto a rotating drum from which it is unwound as it is fed to the knitting machine with the rotation of the drum providing controlled, uniform, yarn supply. Using the ball tension device of the present invention in advance of the yarn storage and supply device assures a substantially uniform tension in the yarn being supplied to, and therefore being dispensed from, the yarn storage and supply device for enhanced quality product and operating efficiency of the knitting machine.

Briefly described, the ball tension device of the present invention includes a base portion having a yarn passageway extending therethrough with an upwardly facing annular ball seat. A ball of a greater diameter than the passageway freely rotatably rests on the seat. A ball retaining portion extends over the ball at an upward spacing therefrom sufficient to allow upward movement of the ball, but insufficient to allow removal of the ball from between the base portion and the ball retaining portion. A mounting portion is disposed for mounting the device to a supporting structure and is connected to the base portion and the ball retaining portion for transverse projection of the base portion and ball retaining portion therefrom to provide a substantially open space between the base portion and the ball retaining portion and around the ball seat and the ball. The open space accommodates a traveling yarn extending between the ball retaining portion and the base portion and between the ball seat and ball and in the passageway, with the ball applying force to the traveling yarn against the seat to provide a substantially uniform tension in the yarn exiting the device.

Preferably, the open space permits entry of a downwardly inclined traveling yarn entering transversely of the device below the ball retaining member between the ball seat and the ball and downwardly through the passageway with the ball applying force to the traveling yarn against the seat to provide a substantially uniform tension in the yarn exiting the device from below the base portion. Alternatively, the device could be used with the yarn traveling upwardly through the passageway, between the ball and seat and outwardly at an upward inclination transversely of the device.

Preferably, a tubular insert member is disposed in the passageway for travel of yarn therethrough and has an annular enlarged upper end forming the seat projecting above the base portion at the passageway.

In the preferred embodiment, the ball retaining portion is in the form of an imperforate cover over the ball and seat to shield the ball and seat from accumulation of lint thereon, with the ball and seat being disposed between the projections of the base portion and the ball retaining portion such that the open space extends substantially fully around the ball and seat to minimize lint accumulation.

To accommodate upward movement of the ball, the ball retaining member preferably has an undersurface facing the ball with an upwardly extending recess therein, with the recess being elongated and extending toward the mounting portion to accommodate movement of the ball transversely toward the mounting member during insertion of a yarn threading tool upwardly through the passageway. In the preferred embodiment, the recess in the undersurface of the ball retaining member is in a partial spherical ovaloid shape. Further, in the preferred embodiment, the mounting portion has a surface facing the ball and extending between the base portion and the ball retaining portion with a recess therein to accommodate movement of the ball transversely toward the mounting movement during insertion of a yarn threading tool upwardly through the passageway.

The ball tension device of the present invention is preferably combined with a yarn storage and supply apparatus of the type having a frame supporting a rotating yarn storage drum around which a plurality of yarn windings are stored as yarn is supplied from the windings to a textile machine and to which yarn is fed to form the windings from a source through an eyelet guide. In this embodiment, the mounting portion is disposed for mounting the ball tension device on the frame of the yarn storage and supply apparatus with the exit of the passageway above and transversely spaced from the eyelet guide for feeding of yarn from the passageway through the eyelet guide to the storage drum, with the result that a yarn of substantially uniform tension exits the device from below the base portion and is fed to the storage drum therefrom.

DESCRIPTION OF THE PREFERRED EMBODIMENTS

Figure 1:
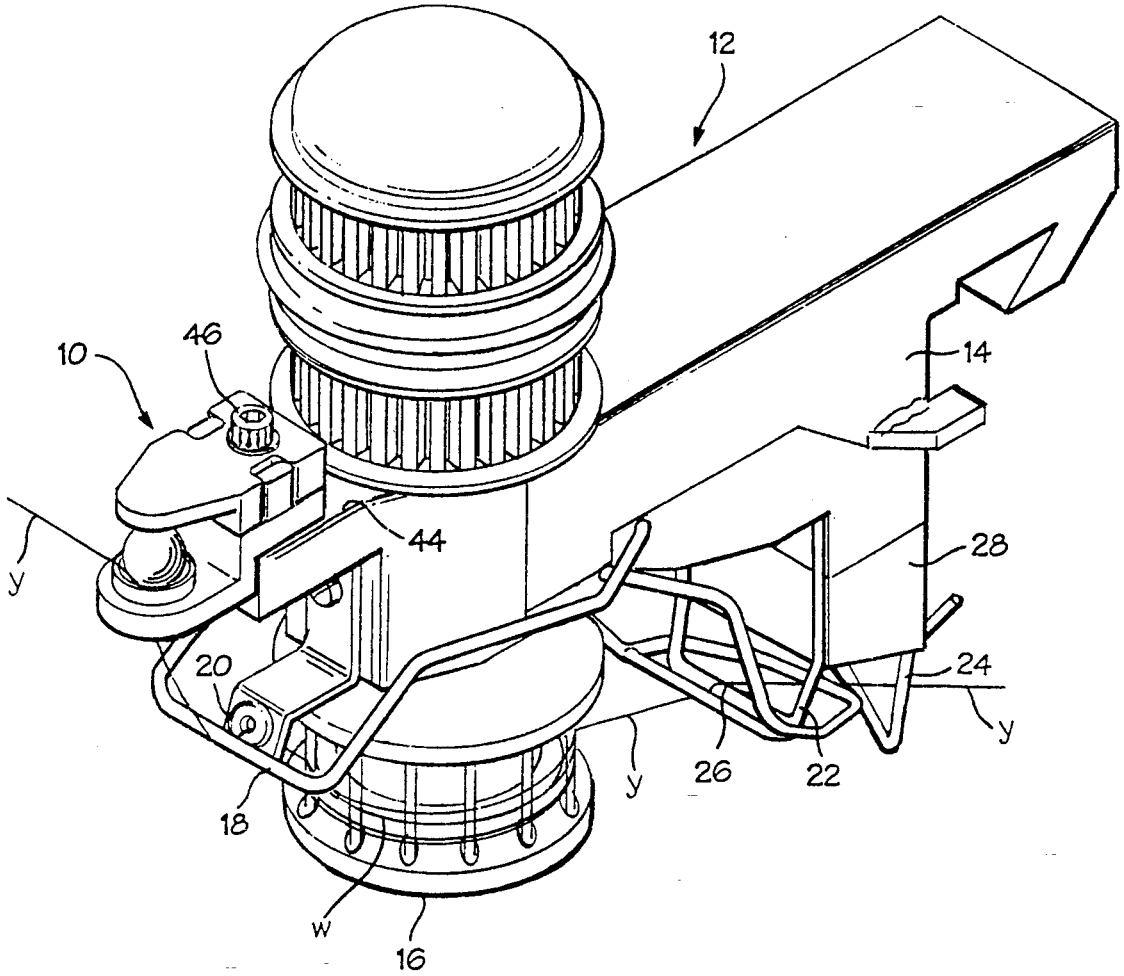
FIG. 1 is a perspective view of a yarn tension device of the preferred embodiment of the present invention in combination with a yarn storage and supply apparatus.
Figure 2:
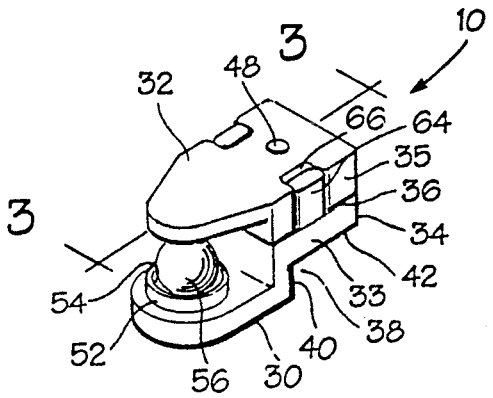
FIG. 2 is a perspective view of the ball tension device of FIG. 1.

Referring to FIG. 1, a ball tension device 10 of the preferred embodiment of the present invention is shown mounted on and operating in combination with a yarn storage and supply apparatus 12 of the type disclosed in U.S. Pat. No. 4,138,866, which includes a frame 14 supporting a rotating yarn storage drum 16 around which a plurality of windings of yarn are stored and the yarn supplied from the windings W to a textile machine, with the yarn Y being fed to form the windings from a source through the ball tension device 10, under a yarn break sensing arm 18, through and eyelet guide 20 onto the drum 16 and from the drum over a pair of support arms 22,24, between which another yarn break sensing arm 26 rests on the traveling yarn. A light 28 is disposed adjacent the support arms 22,24 to indicate to an operator when a yarn break has occurred as sensed by either of the yarn break sensing arms 18 and 26.

Referring to FIGS. 2–5, the ball tension device 10 of FIG. 1 is illustrated in greater detail. This ball tension device 10 includes a base portion 30, a ball retaining portion 32, and a mounting portion 34. These three portions are formed of two pieces of molded plastic with the mounting portion 34 having a part 33 molded integral with the base portion and a part 35 molded integral with the ball retaining portion 32. These parts of the mounting portion 34 have horizontal surfaces 36 facing each other to form the device 10 as a rigid unit upon securing the parts 33 and 35 together.

The base portion 30 is formed as a horizontal projection projecting transversely from the bottom of the mounting portion 34 and the ball retaining portion 32 is formed as a horizontal projection projecting transversely from the top of the mounting portion 34, with the mounting portion 34 having a vertical offset 38 at its outer side to provide a vertical surface 40 and a horizontal surface 42 for seating on a horizontal projection 44 of the frame 14 of the apparatus 12 by a nut and bolt connection 46 extending through the horizontal projection 44 and a vertical bore 48 in the parts 33 and 35 of the mounting portion 34. The horizontally projecting base portion 30 is formed with a vertically extending, cylindrically shaped yarn passageway 50 in which a ceramic insert 52 is secured with an annularly enlarged upper end forming a ball seat 54 projecting above the base portion 30 at the passageway 50.

A metal ball 56 of greater diameter than the passageway 50 formed in the insert 52 freely rotatably rests on the ball seat 54 of the insert 52.

The transversely projecting ball retaining portion 32 is disposed above the base portion 30 and extends over the ball 56 at an upward spacing therefrom sufficient to allow upward movement of the ball on the seat 54 but insufficient to allow removal of the ball 56 from between the base portion 30 and the ball retaining portion 32. With this arrangement, the ball will not be inadvertently dislodged from the device 10 nor can it be exchanged for another ball so long as the portions of the device are secured together. This prevents improper replacement of balls by an inexperienced operator, which could result in different tension being applied to different yarns being run through ball tension devices 10 on the same textile manufacturing or processing machine.

The arrangement of the transverse projection of the base portion 30 and ball retaining portion 32 from the mounting portion 34 provides a substantially open space between the base portion 30 and the ball retaining portion 32 around the ball seat 54 and ball 56, with this open space permitting entry of a downwardly inclined traveling yarn Y entering transversely of the device below the ball retaining member 32 and between the ball seat 54 and ball 56, downwardly through the passageway 50 with the ball 56 applying force to the traveling yarn Y against the seat 54 to provide a substantially uniform tension in the yarn exiting the device from the passageway 50 below the base portion 30.

The ball retaining portion 32 serves as an imperforate cover over the ball 56 and seat 54 to shield the ball and seat from undesirable accumulation of lint thereon during operation of the equipment. Also, to minimize lint accumulation, the open space between the base portion 30 and ball retaining portion 32 extends substantially fully around the ball 56 and seat 54. This open space further permits introduction of the yarn Y in any selected direction extending over more than 180° of the circumference of the ball seat 54.

The ball retaining portion 32 has an undersurface 58 facing the ball 56. This undersurface 58 is formed with an upwardly extending recess 60 to accommodate upward movement of the ball 56 during travel of a yarn Y through the device with the unrecessed peripheral portion of the undersurface 58 being disposed downwardly from the interior of the recess 60 to retain the ball 56 in assembly with the base portion 30 and ball retaining portion 32. Thus, during operation, the ball is free to move, at least partially, from and around the seat 54 as may be caused by the tension in the yarn Y as it is being fed to the ball tension device 10.

Figure 3:
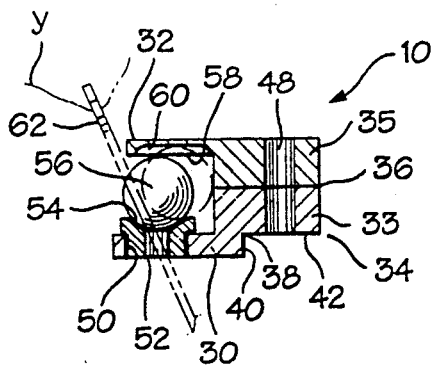
FIG. 3 is a vertical sectional view taking along the line 3—3 in FIG. 2.
Figure 4:
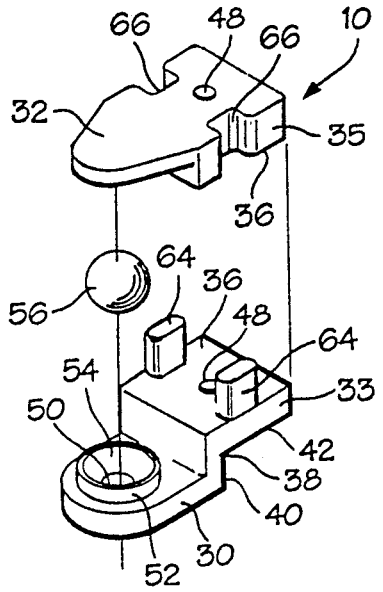
FIG. 4 is an exploded perspective view of the ball tension device of FIG. 2 as viewed in substantially the same direction.
Figure 5:
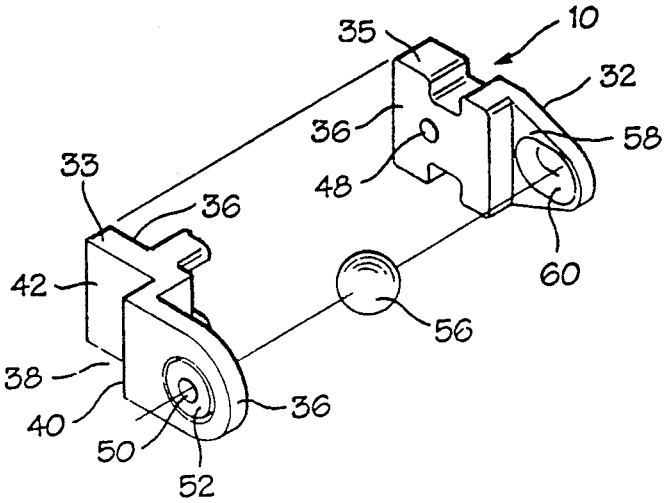
FIG. 5 is another exploded perspective view of the ball tension device of FIG. 2 viewed from below and to the side of the device.
Figure 6:
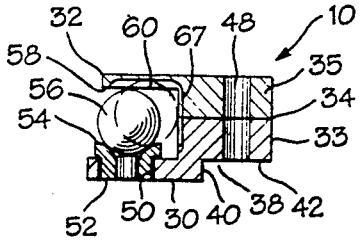
FIG. 6 is a vertical sectional view similar to FIG. 3 illustrating a modified embodiment of the ball tension device of the present tension.
Figure 7:
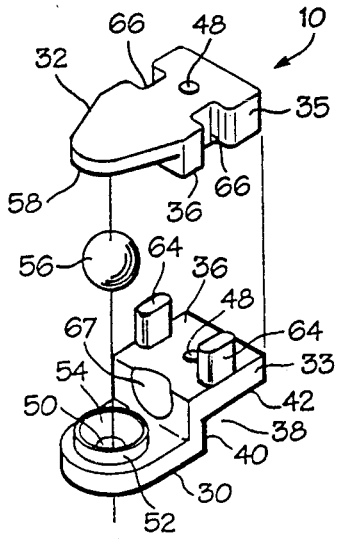
FIG. 7 is an exploded perspective view similar to FIG. 4 and illustrating the modified embodiment of FIG. 6.
Figure 8:
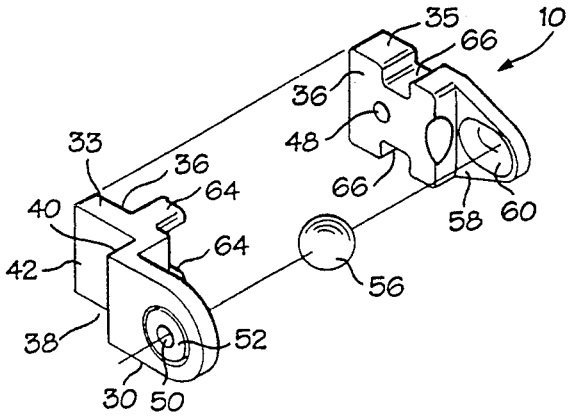
FIG. 8 is an exploded perspective view similar to FIG. 5 and illustrating the modified embodiment of FIG. 6.
Figure 9:
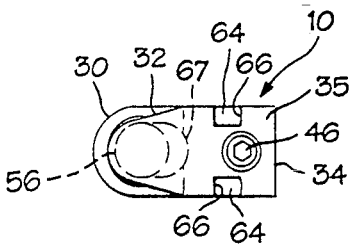
FIG. 9 is a top view of the modified embodiment of FIG. 6.

As illustrated in FIGS. 3 and 5, the recess 60 in the undersurface 58 of the ball retaining portion 32 is elongated in a direction from above the passageway 50 to extend toward the mounting portion 34, thereby providing a recessed space for accommodating movement of the ball 56 transversely toward the mounting portion 34 during insertion of a yarn threading tool 62 upwardly through the passageway 50 when initially threading yarn Y into the device 10. As seen in FIGS. 3 and 5, the recess with this transverse elongation results in a shape that can be characterized as being a partial spherical ovaloid shape.

The parts 33 and 35 of the mounting portion 34 are secured together by the lower part having a pair of spaced, vertically projecting studs 64 that are tightly received in a pair of opposed recesses 66 formed in the side edges of the top part of the mounting portion 34. To prevent separation of the parts and maintain the portions of the device 10 integrally secured together, the studs 64 may be glued or otherwise secured in the recesses 64 against separation.

Referring to the modified embodiment illustrated in FIGS. 6–9, the construction of all of the components is identical to the embodiment of FIGS. 1–5, except for the additional feature of a recess 67 formed in a surface of the mounting portion 34 facing the ball 56. This recess 67 is shaped similarly to the elongated recess 60 in the undersurface 58 of the ball retaining portion 32, but extends vertically. This recess 67 accommodates movement of the ball 56 transversely toward the mounting member 34 during insertion of a yarn threading tool 62 upwardly through the passageway in combination with the movement accommodated by the recess 60 in the undersurface 58 of the ball retaining portion 32. Otherwise, the components of the modified embodiment of FIGS. 6–9 bear the same reference numerals as the corresponding identical components of the embodiment of FIGS. 1–5.

With this ball tension device 10 of the present invention, yarn Y can be positioned for travel to and through the yarn passageway 50 between the ball 56 and seat 54 from a wide range of horizontal positions and also from a wide range of vertical positions relative to the device 10 with the ball 56 acting on the yarn passing between it and the seat 54 in substantially the same way regardless of the feeding direction or position of the yarn and resulting in substantially the same uniform tension in the yarn exiting from the device 10 regardless of the angle and position. Alternatively, the device 10 can be used in an arrangement where the yarn travels upwardly through the passageway 50, between the ball 56 and seat 54, and upwardly and outwardly to the side of the device.

To further minimize the accumulation of lint, the yarn can be fed from a package supply through a tube (not shown) that can be disposed with an end closely adjacent the ball 56 and seat 54 due to the substantial open space between the base portion 30 and ball retaining portion 32.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A ball tension device for producing generally uniform tension in a traveling textile yarn comprising:

a base portion having a yarn passageway extending therethrough with an upwardly facing annular ball seat;

a ball of a greater diameter than the passageway at the annular seat freely rotatably resting on the seat;

a ball retaining portion extending over the ball at an upward spacing therefrom sufficient to allow upward movement of the ball but insufficient to allow removal of the ball from between said base portion and said ball retaining portion, said ball retaining portion being in the form of an imperforate cover over said ball and seat to shield said ball and seat from accumulation of lint thereon; and a mounting portion disposed for mounting said device to a supporting structure and connected to said base portion and said ball retaining portion for transverse projection of said base portion and said ball retaining portion therefrom to provide a substantially open space between said base portion and said ball retaining portion and around said ball seat and said ball with said open space extending continuously around a major peripheral extent of said all seat and ball and permitting entry of a downwardly inclined traveling yarn entering transversely of said device below said ball retaining portion between said ball seat and said ball and downwardly through said passageway with said ball applying force to the traveling yarn against said seat to provide a substantially uniform tension in the yarn exiting the device.

2. A ball tension device according to claim 1 and characterized further in that said ball and seat are disposed between said base portion and said ball retaining portion projecting from said mounting portion with the open space extending substantially fully around said ball and seat to minimize lint accumulation.

3. A ball tension device according to claim 1 and characterized further in that said ball retaining portion has an undersurface facing said ball with an upwardly extending recess therein to accommodate upward movement of said ball.

4. A ball tension device according to claim 3 and characterized further in that said recess is elongated and extends toward said mounting portion to accommodate movement of said ball transversely toward said mounting member during insertion of a yarn threading tool upwardly through said passageway.

5. A ball tension device according to claim 4 and characterized further in that said recess is in a partial spherical ovaloid shape.

6. A ball tension device according to claim 3 and characterized further in that said mounting portion has a surface facing said ball and extending between said base portion and said ball retaining portion with a recess therein to accommodate movement of said ball transversely toward said mounting member during insertion of a yarn threading tool upwardly through said passageway.

7. In combination with a yarn storage and supply apparatus of the type having a frame supporting a rotating yarn storage drum around which a plurality of windings of yarn are stored and the yarn supplied from the windings to a textile machine, with the yarn being fed to form the windings from a source through an eyelet guide, a ball tension device for producing general uniform tension to a yarn traveling therefrom through said eyelet guide to said storage drum comprising:

a base portion having a yarn passageway extending therethrough with an upwardly facing annular ball seat;

a ball of a greater diameter than the passageway at the annular seat freely rotatably resting on the seat;

a ball retaining portion extending over the ball at an upward spacing therefrom sufficient to allow upward movement of the ball but insufficient to allow removal of the ball from between said base portion and said ball retaining portion said ball retaining portion being in the form of an imperforate cover over said ball and seat to shield said ball and seat from accumulation of lint thereon; and p1 a mounting portion disposed for mounting said ball tension device on the frame of said yarn storage and supply apparatus with the exit of said passageway above and transversely spaced from said eyelet guide for feeding of yarn from said passageway through said eyelet guide to said storage drum, said mounting portion being connected to said base portion and said ball retaining portion for transverse projection of said base portion and said ball retaining portion therefrom to provide a substantially open space between said base portion and said ball retaining portion and around said ball seat and said ball with said open space permitting entry of a downwardly inclined traveling yarn entering transversely of said device below said ball retaining portion and said base portion and between said ball seat and said ball and downwardly through said passageway with said ball applying force to the traveling yarn against said seat to provide a substantially uniform tension in the yarn exiting the device and being fed to said storage drum.

8. A ball tension device according to the combination of claim 7 and characterized further in that said ball and seat are disposed between said base portion and said ball retaining portion projecting from said mounting portion with the open space extending substantially fully around said ball and seat to minimize lint accumulation.

9. A ball tension device according to the combination of claim 7 and characterized further in that said ball retaining portion has an undersurface facing said ball with an upwardly extending recess therein to accommodate upward movement of said ball.

10. A ball tension device according to the combination of claim 9 and characterized further in that said recess is elongated and extends toward said mounting portion to accommodate movement of said ball transversely toward said mounting member during insertion of a yarn threading tool upwardly through said passageway.

11. A ball tension device according to the combination of claim 10 and characterized further in that said recess is in a partial spherical ovaloid shape.

12. A ball tension device according to the combination of claim 9 and characterized further in that said mounting portion has a surface facing said ball and extending between said base portion and said ball retaining portion with a recess therein to accommodate movement of said ball transversely toward said mounting member during insertion of a yarn threading tool upwardly through said passageway.

* * * * *

UNITED STATES PATENT AND TRADEMARK OFFICE

CERTIFICATE OF CORRECTION

PATENT NO. : 5,318,233

DATED : June 7, 1994

INVENTOR(S) : Otto Zollinger

It is certified that error appears in the above-identified patent and that said Letters Patent is hereby corrected as shown below:

Column 3, line 17, delete "taking" and insert therefor -- taken --.

Column 3, line 27, delete "tension" and insert therefor -- invention --.

Column 3, line 49, delete "and" and insert therefor -- an --.

Column 6, line 38, delete "all" and insert therefor -- ball --.

Column 7, line 27, delete "pl".

Column 7, line 27, begin a new paragraph after "; and".

Signed and Sealed this

Seventh Day of March, 1995

*Attest:*

Bruce Lehman

BRUCE LEHMAN

*Attesting Officer*

*Commissioner of Patents and Trademarks*